US009845979B2

(12) United States Patent
Tsai et al.

(10) Patent No.: US 9,845,979 B2
(45) Date of Patent: Dec. 19, 2017

(54) EVAPORATOR FOR A CASCADE REFRIGERATION SYSTEM

(71) Applicant: WinWay Tech. Co., Ltd., Nanzih Dist., Kaohsiung (TW)

(72) Inventors: Ying-Chi Tsai, Kaohsiung (TW); Yu-Pin Hsu, Kaohsiung (TW); Chia-Pin Sun, Kaohsiung (TW)

(73) Assignee: WINWAY TECH. CO., LTD., Kaohsiung (TW)

( * ) Notice: Subject to any disclaimer, the term of this patent is extended or adjusted under 35 U.S.C. 154(b) by 84 days.

(21) Appl. No.: 14/969,733

(22) Filed: Dec. 15, 2015

(65) Prior Publication Data

US 2017/0167765 A1 Jun. 15, 2017

(51) Int. Cl.

| | |
|---|---|
| ***F25B 39/00*** | (2006.01) |
| ***F25B 5/00*** | (2006.01) |
| ***F25B 7/00*** | (2006.01) |
| *F25B 39/02* | (2006.01) |

(52) U.S. Cl.

CPC ..... *F25B 39/00* (2013.01); *F25B 5/00* (2013.01); *F25B 7/00* (2013.01); *F25B 39/02* (2013.01)

(58) Field of Classification Search

CPC .... F25B 39/00; F25B 5/00; F25B 7/00; F25B 39/02; F25B 39/04; F25B 39/022; F25B 39/028; F25B 39/024

USPC ..... 62/524

See application file for complete search history.

(56) References Cited

U.S. PATENT DOCUMENTS

| | | | | |
|---|---|---|---|---|
| 4,474,026 | A * | 10/1984 | Mochizuki | F25B 5/00 62/157 |
| 9,200,822 | B2 | 12/2015 | Jeon et al. | |
| 2010/0147006 | A1* | 6/2010 | Taras | F25B 7/00 62/335 |
| 2011/0094259 | A1* | 4/2011 | Lifson | F25B 1/10 62/510 |
| 2011/0120158 | A1* | 5/2011 | Choi | F25B 7/00 62/113 |
| 2012/0216551 | A1* | 8/2012 | Minor | C09K 5/045 62/79 |
| 2012/0241139 | A1* | 9/2012 | Katoh | F28D 1/0426 165/202 |

(Continued)

FOREIGN PATENT DOCUMENTS

| | | |
|---|---|---|
| CN | 202048726 U | 11/2011 |
| CN | 103335457 A | 10/2013 |
| CN | 204084961 U | 1/2015 |

(Continued)

OTHER PUBLICATIONS

Search Report from related Taiwanese Patent Application No. 104120582, dated Jan. 26, 2016.

*Primary Examiner* — Mohammad M Ali

(74) *Attorney, Agent, or Firm* — Merchant & Gould P.C.

(57) ABSTRACT

An evaporator includes a casing and a plurality of circulation units disposed on the casing. Each of the circulation units includes a flow path formed in the casing, an inlet formed in the casing for entry of one of refrigerants into the casing and fluidly communicating with the flow path, and an outlet formed in the casing spaced apart from the inlet for exit of the one of the refrigerants out the casing and fluidly communicating with the flow path. The circulation units are independent from each other and do not fluidly communicate with each other.

2 Claims, 12 Drawing Sheets

(56) References Cited

U.S. PATENT DOCUMENTS

| | | | | |
|---|---|---|---|---|
| 2013/0091891 | A1* | 4/2013 | Hinde | F25B 43/02 62/470 |
| 2013/0312453 | A1* | 11/2013 | Jeon | F25B 39/028 62/524 |

FOREIGN PATENT DOCUMENTS

| | | | |
|---|---|---|---|
| CN | 104350352 | A | 2/2015 |
| JP | 2005-308384 | A | 11/2005 |

* cited by examiner

EVAPORATOR FOR A CASCADE REFRIGERATION SYSTEM

FIELD

The disclosure relates to an evaporator, and more particularly to an evaporator for a cascade refrigeration system.

BACKGROUND

Referring to FIG. 1, an existing single refrigerant refrigeration system includes a compressor 11, a condenser 12 disposed downstream of and fluidly connected to the compressor 11, an expansion valve 13 disposed downstream of and fluidly connected to the condenser 12, and an evaporator 14 disposed downstream of the expansion valve 13 and upstream of the compressor 11.

During operation of the existing single refrigerant refrigeration system, a refrigerant 101 flows into the compressor 11 and is compressed into a high-temperature and high-pressure gasified refrigerant 101, after which it flows into the condenser 12 and is condensed into a normal-temperature and high-pressure liquefied refrigerant 101. Next, the normal-temperature and high-pressure liquefied refrigerant 101 flows into the expansion valve 13 and is converted into a low-temperature and low-pressure liquefied refrigerant 101. Afterwards, the low-temperature and low-pressure liquefied refrigerant 101 flows into the evaporator 14, absorbs heat, and is converted into a low-temperature and low pressure gasified refrigerant 101 which then flows back into the compressor 11. The existing single refrigerant refrigeration system is generally used in an air conditioning system and a refrigeration system. However, the cooling temperature of the existing single refrigerant refrigeration system ranges between 10° C. and 30° C. If a lower temperature refrigeration system is required, a dual refrigerant refrigeration system must be used.

Referring to FIG. 2, an existing dual refrigerant refrigeration system includes a liquefaction unit 15 and a cooling unit 16. The liquefaction unit 15 includes a liquefaction compressor 151, a liquefaction condenser 152 fluidly connected to the liquefaction compressor 151, a liquefaction expansion valve 153 fluidly connected to the liquefaction condenser 152, and a heat exchanger 154 fluidly interconnecting the liquefaction expansion valve 153 and the liquefaction compressor 151. The cooling unit 16 includes a cooling compressor 161 fluidly connected to the heat exchanger 154, a cooling expansion valve 162 fluidly connected to the heat exchanger 154, and a cooling evaporator 163 fluidly connected to the cooling expansion valve 162 and the cooling compressor 161.

The liquefaction unit 15 uses, for example, R404 A or R 507 refrigerant 105, which can be liquefied at high pressure and normal temperature. The cooling unit 16 uses, for example, R23 refrigerant 106, which cannot be liquefied at high pressure and normal temperature. By virtue of the heat exchanger 154, the refrigerant 105 of the liquefaction unit 15 can liquefy the refrigerant 106 of the cooling unit 16 so that the refrigeration system can provide a cooling temperature of about −85° C.

When a wide range of the cooling temperature is required, the existing practice is to equip the refrigeration system with the single refrigerant refrigeration system and the dual refrigerant refrigeration system simultaneously. However, the production and maintenance costs of these two refrigeration systems are not only relatively high, but also they occupy a substantial space.

SUMMARY

Therefore, an object of the disclosure is to provide an evaporator for a multi-refrigerant refrigeration system that can alleviate the drawback of the prior art.

According to the disclosure, an evaporator for a cascade refrigeration system includes a casing and a plurality of circulation units disposed on the casing. Each of the circulation units includes a flow path formed in the casing, an inlet formed in the casing for entry of one of refrigerants into the casing and fluidly communicating with the flow path, and an outlet formed in the casing spaced apart from the inlet for exit of the one of the refrigerants out the casing and fluidly communicating with the flow path. The circulation units are independent from each other and do not fluidly communicate with each other.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
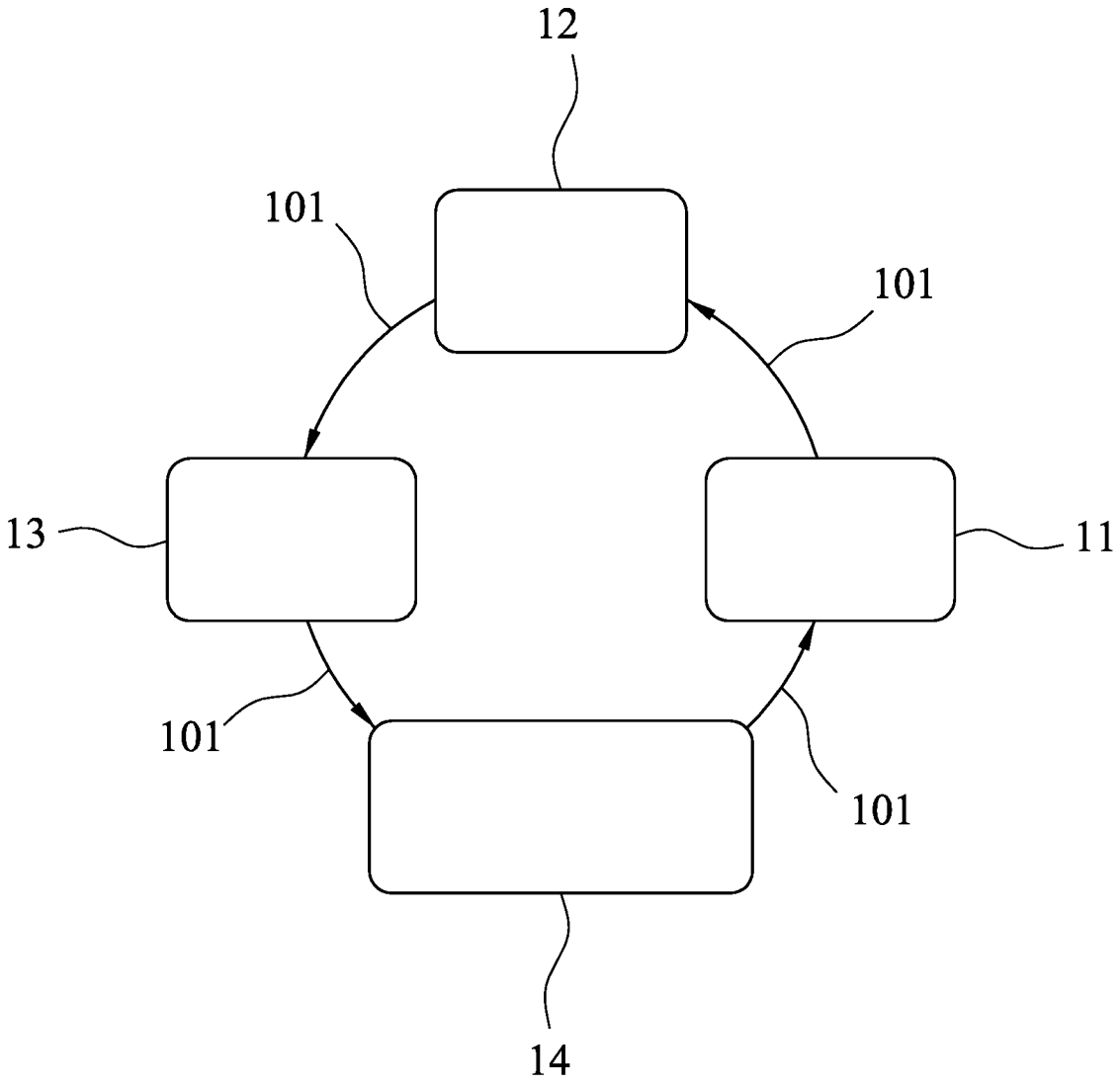
FIG.1 PRIOR ART
FIG. 1 is a schematic diagram illustrating a conventional single refrigerant refrigeration system.
Figure 2:
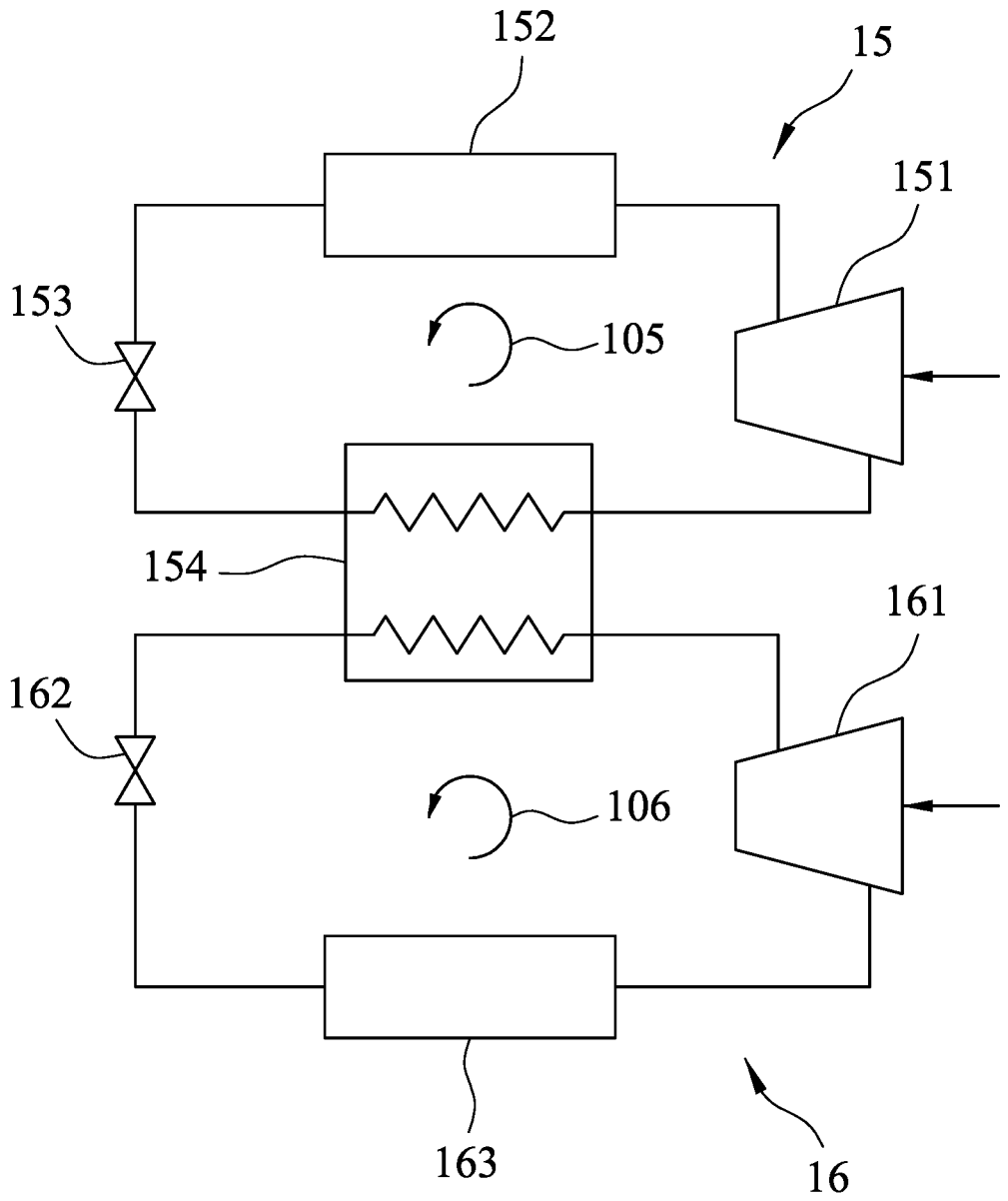
FIG.2 PRIOR ART
FIG. 2 is a schematic diagram illustrating a conventional dual refrigerant refrigeration system.

Before the present disclosure is de scribed in greater detail, it should be noted that like elements are denoted by the same reference numerals throughout the disclosure.

Figure 3:
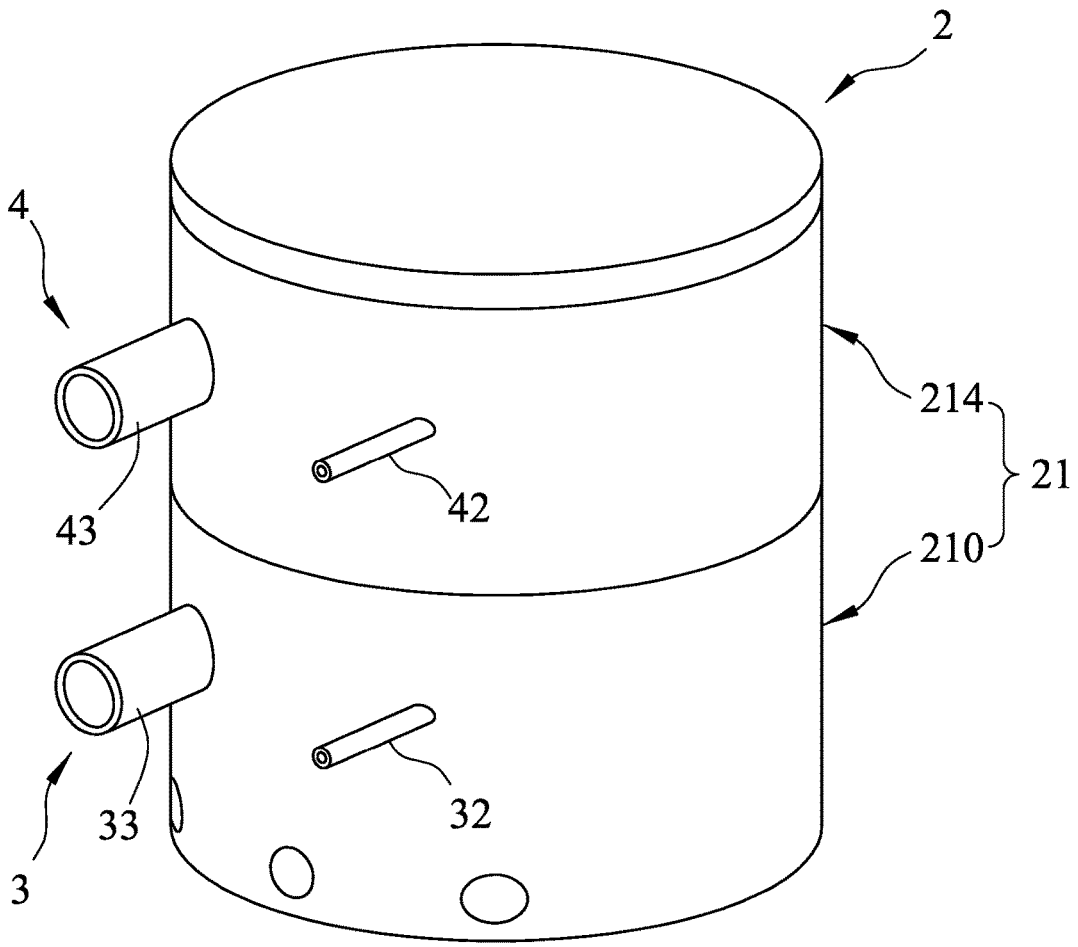
FIG. 3 is a perspective view of a first embodiment of an evaporator for a cascade refrigeration system according to the disclosure.
Figure 4:
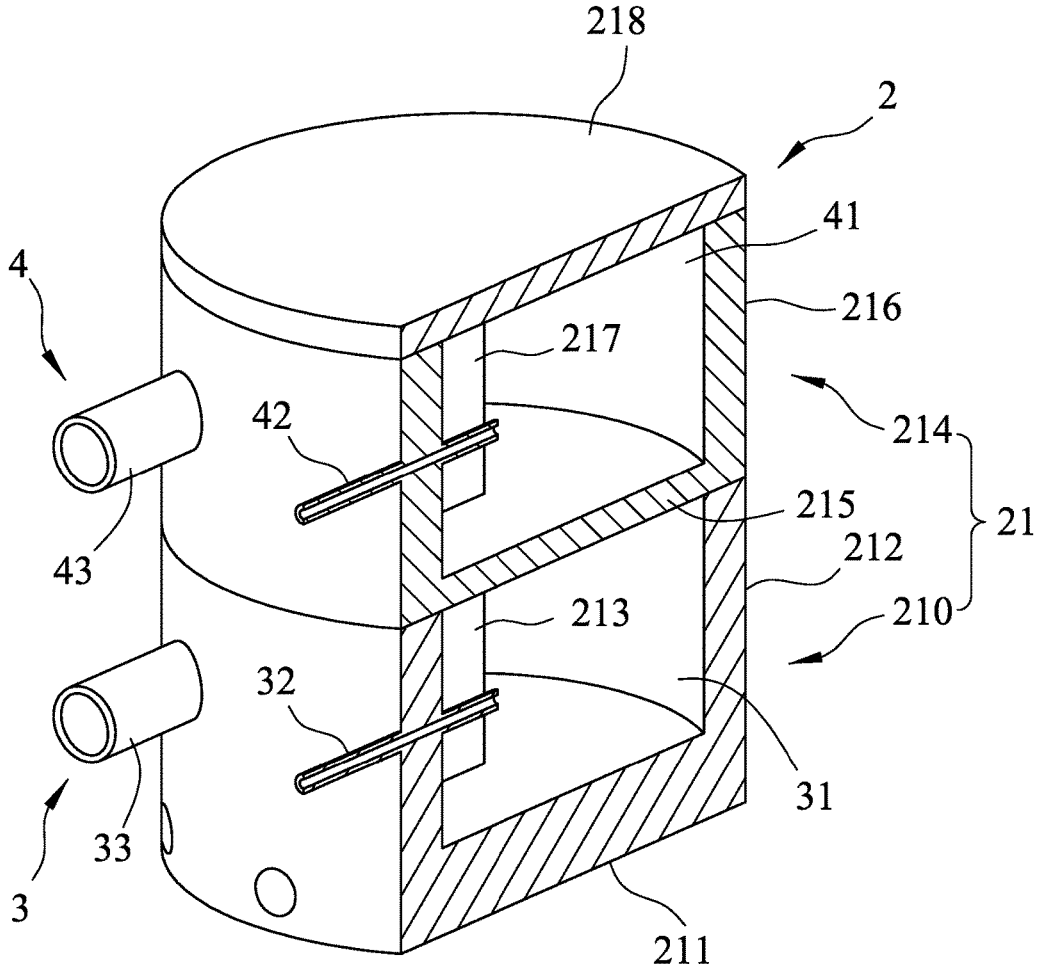
FIG. 4 is a view similar to FIG. 3, but with a portion thereof being removed for the sake of clarity.
Figure 5:
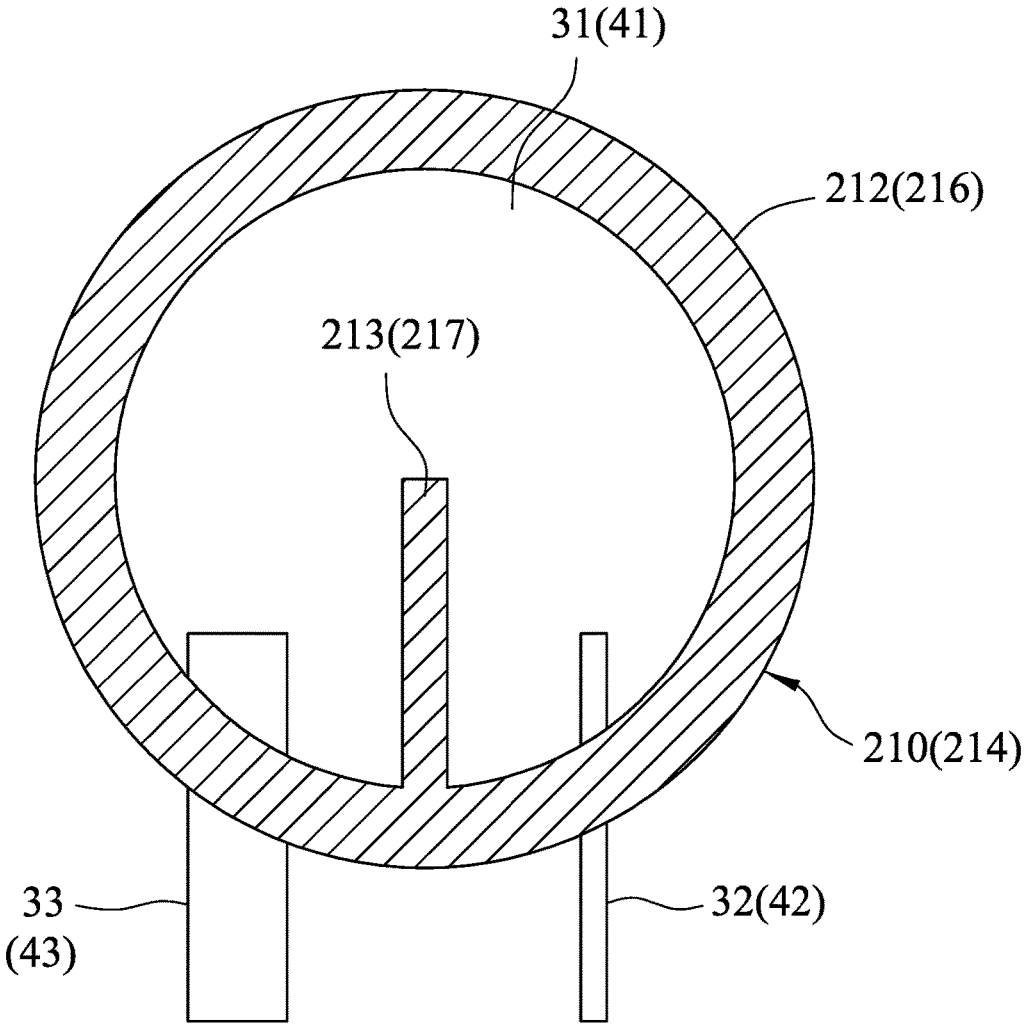
FIG. 5 is a sectional view of the first embodiment.

Referring to FIGS. 3 to 5, an evaporator 2 for a cascade refrigeration system according to the first embodiment of the disclosure includes a substantially cylindrical-shaped casing 21 and first and second circulation units 3, 4.

The casing 21 includes abase seat 210 and a connection seat 214 stacked on the base seat 210.

The base seat 210 includes a base wall 211, a first surrounding wall 212 surrounding the base wall 211, and a first partition plate 213 protruding inwardly from the first surrounding wall 212.

The connection seat 214 includes a connecting wall 215 connected to the first surrounding wall 212 opposite to the base wall 211, a second surrounding wall 216 surrounding the connecting wall 215, a second partition plate 217 protruding inwardly from the second surrounding wall 216, and a top wall 218 connected to the second surrounding wall 216 opposite to the connecting wall 215.

The first circulation unit 3 is disposed on the base seat 210, and includes a first flow path 31 cooperatively defined by the base wall 211, the first surrounding wall 212, the first partition plate 213 and the connecting wall 215, a first inlet 32 formed in the first surrounding wall 212 for entry of a refrigerant into the casing 21 and fluidly communicating with the first flow path 31, and a first outlet 33 formed in the first surrounding wall 212 spaced apart from the first inlet 32 for exit of the refrigerant out of the casing 21 and fluidly communicating with the first flow path 31. The first flow path 31 has a substantially C-shape (see FIG. 5).

The second circulation unit 4 is disposed on the connection seat 214, and includes a second flow path 41 cooperatively defined by the connecting wall 215, the second surrounding wall 216, the second partition plate 217 and the top wall 218, a second inlet 42 formed in the second surrounding wall 216 for entry of another refrigerant into the casing 21 and fluidly communicating with the second flow path 41, and a second outlet 43 formed in the second surrounding wall 216 spaced apart from the second inlet 42 for exit of the another refrigerant out of the casing 21 and fluidly communicating with the second flow path 41. The second flow path 41 also has a substantially C-shape (see FIG. 5).

By virtue of the connecting wall 215 separating the first and second flow paths 31, 41, the first and second flow paths 31, 41 are independent from each other and do not fluidly communicate with each other.

Figure 6:
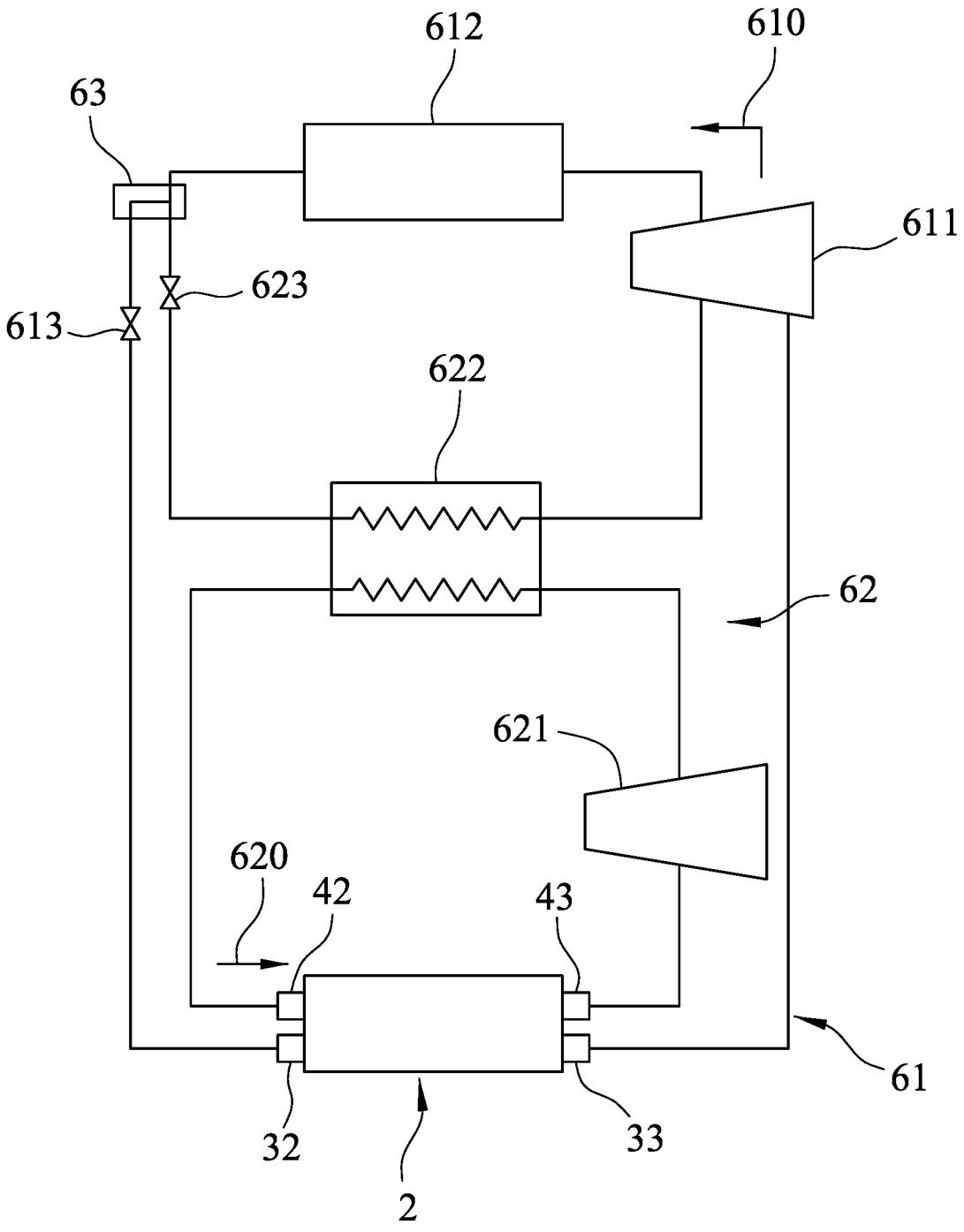
FIG. 6 is a schematic diagram illustrating the first embodiment in a state of use.

Referring to FIG. 6, in combination with FIGS. 3 and 5, in actual practice, the evaporator 2 is suitable for use in a dual refrigerant refrigeration system. The dual refrigerant refrigeration system includes a first cooling unit 61, a second cooling unit 62 and a switching valve 63. In this embodiment, the first cooling unit 61 circulates R 507 refrigerant which is designated as 610 in the figure, and the second cooling unit 62 circulates R 23 refrigerant which is designated as 620 in the figure.

The first cooling unit 61 includes a first compressor 611 fluidly connected to the first outlet 33 of the evaporator 2, a first condenser 612 disposed downstream of the first compressor 611 and upstream of the switching valve 63, and a first expansion valve 613 disposed downstream of the switching valve 63 and upstream of the first inlet 32 of the evaporator 2.

The second cooling unit 62 includes a second compressor 621 fluidly connected to the second outlet 43 of the evaporator 2, a heat exchanger 622 fluidly connected to the first and second compressors 611, 621 and the second inlet 42 of the evaporator 2, and a second expansion valve 623 fluidly connected to the heat exchanger 622 and the switching valve 63.

When a cooling temperature of a single refrigerant refrigeration system is required, the second compressor 621 is turned off, and the switching valve 63 is switched for fluidly connecting the first condenser 612, the first expansion valve 613 and the first inlet 32 of the evaporator 2.

The refrigerant 610 flows into the first compressor 611 and is compressed into a high-temperature and high-pressure gasified refrigerant 610, after which it flows into the first condenser 612 and is condensed into a normal-temperature and high-pressure liquefied refrigerant 610. Next, the normal-temperature and high-pressure liquefied refrigerant 610 flows into the expansion valve 613 through the switching valve 63 and is converted into a low-temperature and low-pressure liquefied refrigerant 610. Afterwards, the low-temperature and low-pressure liquefied refrigerant 610 enters the first inlet 32 into the evaporator 2, absorbs heat, and is converted into a low-temperature and low-pressure gasified refrigerant 610 which then exits the first outlet 33 to flow back into the first compressor 611 to complete a cooling cycle of the first cooling unit 61, so that the evaporator 2 can provide a cooling temperature of about −50° C.

When a cooling temperature of a dual refrigerant refrigeration system is required, the switching valve 63 is switched for fluidly connecting the first condenser 612, the second expansion valve 623 and the heat exchanger 622. The high-temperature and high-pressure refrigerant 610 exiting from the first compressor 611 is converted into the normal-temperature and high-pressure liquefied refrigerant 610 after passing through the first condenser 612, and flows to the second expansion valve 623 through the switching valve 63. Through the second expansion valve 623, the normal-temperature and high-pressure liquefied refrigerant 610 is converted into a low-temperature and low-pressure liquefied refrigerant 610 which then flows into the heat exchanger 622, absorbs heat and is converted into a low-temperature and low-pressure gasified refrigerant 610. The low-temperature and low-pressure gasified refrigerant 610 then flows back into the first compressor 611 to complete a cooling cycle among the first compressor 611, the first condenser 612, the switching valve 63, the second expansion valve 623 and the heat exchanger 622.

When the temperature of the refrigerant 610 is sufficient to liquefy the refrigerant 620 during heat exchange in the heat exchanger 622, the second compressor 621 is turned on to compress the refrigerant 620 that flows therein into a high-temperature and high-pressure gasified refrigerant 620 which then flows to the heat exchanger 622. At the heat exchanger 622, the low-temperature and low-pressure liquefied refrigerant 610 exchanges heat with the high-temperature and high-pressure gasified refrigerant 620 to convert into the low-temperature and low-pressure gasified refrigerant 610 that flows back into the first compressor 611. The high-temperature and high-pressure gasified refrigerant 620, on the other hand, is converted into a low-temperature and low-pressure liquefied refrigerant 620 that flows to the evaporator 2. The low-temperature and low-pressure liquefied refrigerant 620 enters the second inlet 42 and exits the second outlet 43 of the second circulation unit 4 to flow back into the second compressor 621 to complete a cooling cycle among the second compressor 621, the heat exchanger 622, the evaporator 2. The evaporator 2 can provide a cooling temperature of about −85° C. It should be noted that when the refrigerant 620 is circulating in the second flow path 41 of the second circulation unit 4, the refrigerant 610 is temporarily stopped from circulating in the first flow path 31 of the first circulation unit 3.

By using the first and second flow paths 31, 41 of the first and second circulation units 3, 4 which are independent from and not fluidly communicating with each other in the evaporator 2 for respectively circulating the refrigerant 610 and the refrigerant 620, the cascade refrigeration system having the evaporator 2 of the disclosure simultaneously has the cooling capacity of a single refrigerant refrigeration system and a dual refrigerant refrigeration system, thereby reducing costs of the refrigeration system and space wastage.

Figure 7:
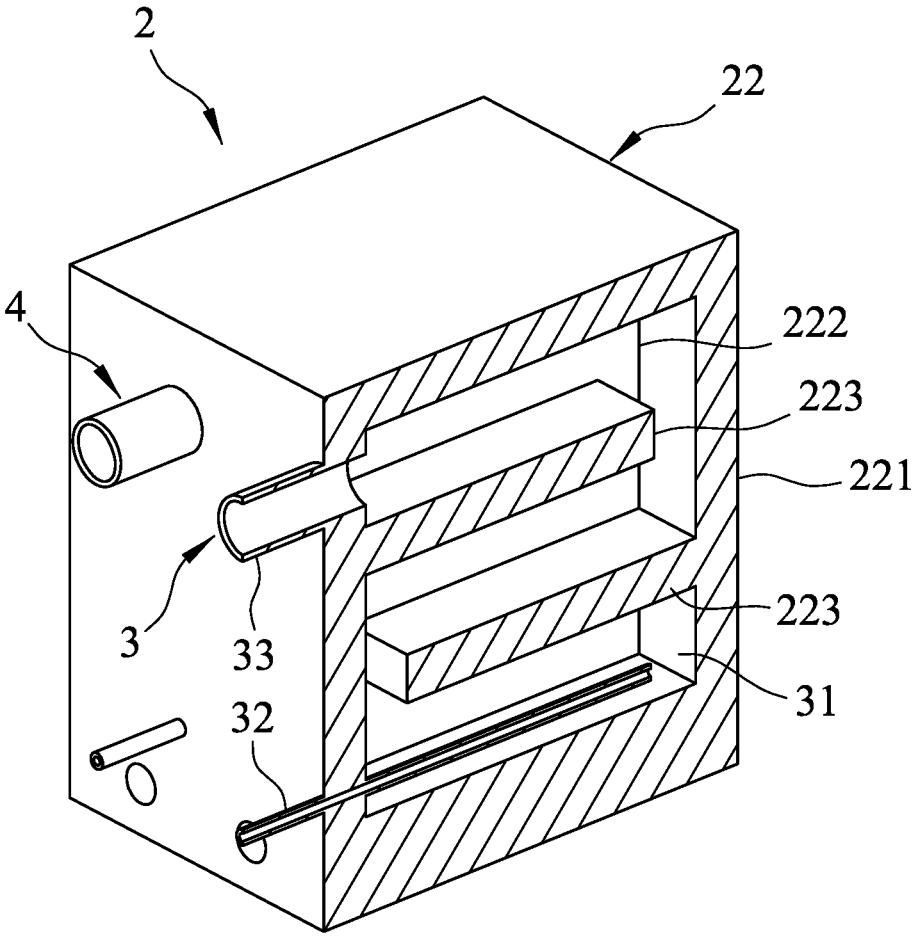
FIG. 7 is a perspective view of a second embodiment of an evaporator for a cascade refrigeration system according to the disclosure with a portion thereof being removed to illustrate an aspect of a first circulation unit thereof.
Figure 8:
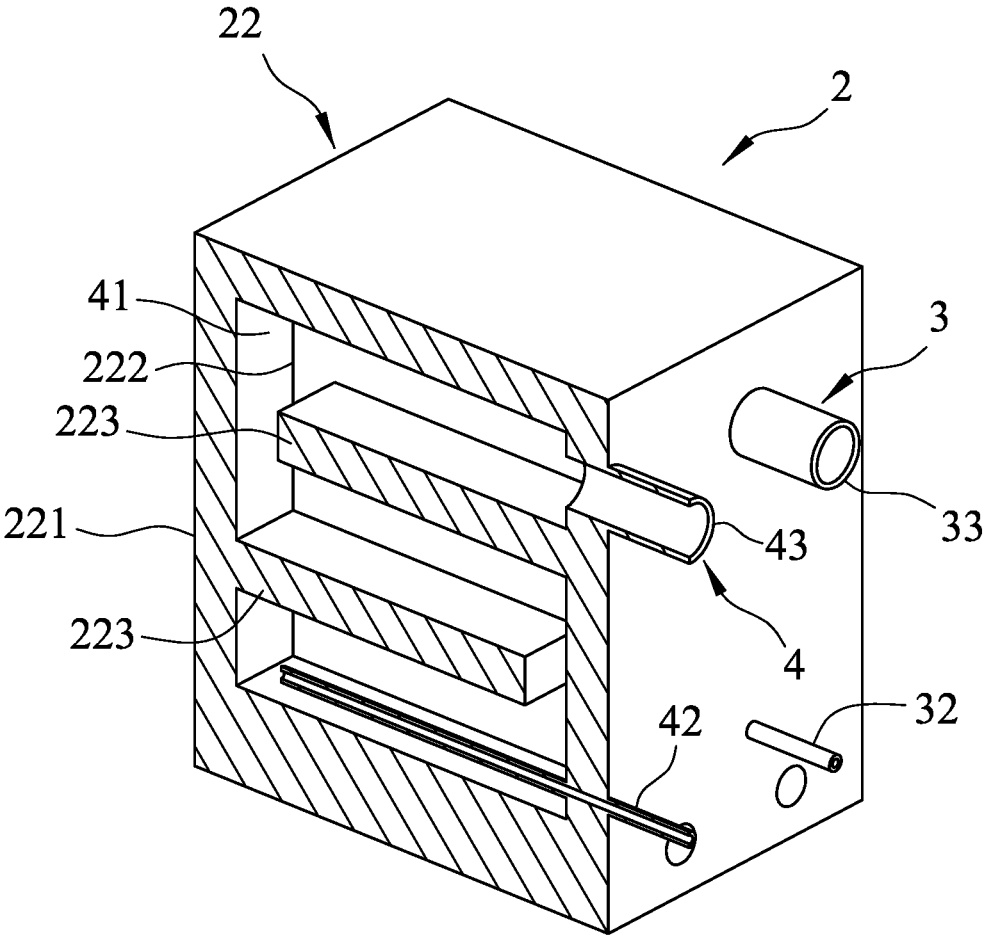
FIG. 8 is a view similar to FIG. 7, but taken from another angle to illustrate an aspect of a second circulation unit thereof.

FIGS. 7 and 8 illustrate an evaporator 2 for a cascade refrigeration system according to the second embodiment of the disclosure which is generally similar to the first embodiment. The differences between the first and second embodiments reside in that the casing 22 includes a casing body 221, and a partition plate 222 disposed in the casing body 221 and extending in a height direction of the casing body 221 to divide the casing body 221 into two parts, and a plurality of flow guide plates 223 projecting transversely from two opposite sides of the partition plate 222 and spaced apart from each other in the height direction of the casing body 221. In this embodiment, two spaced-apart flow guide plates 223 project from each of two opposite sides of the partition plate 222 into a corresponding one of the parts of the casing body 221. The first and second circulation units 3, 4 are respectively disposed on the two parts of the casing body 221.

The casing body 221, the partition plate 222 and the flow guide plates 223 at one of the two opposite sides of the partition plate 222 cooperatively define the first flow path 31 of the first circulation unit 3. The first flow path 31 of the first circulation unit 3 has a substantially S-shape (see FIG. 7). The casing body 221, the partition plate 222 and the flow guide plates 223 at the other side of the partition plate 222 cooperatively define the second flow path 41 of the second circulation unit 4. The second flow path 41 of the second circulation unit 4 also has a substantially S-shape (see FIG. 8).

The first inlet 32 and the first outlet 33 of the first circulation unit 3 are located on one side of the partition wall 222, are spaced apart from each other in the height direction of the casing body 221, and fluidly communicate with the first flow path 31. The second inlet 42 and the second outlet 43 of the second circulation unit 4 are located on the other side of the partition wall 222, are spaced apart from each other in the height direction of the casing body 221, and fluidly communicate with the second flow path 41.

The second embodiment has the same advantages as those of the first embodiment.

Figure 9:
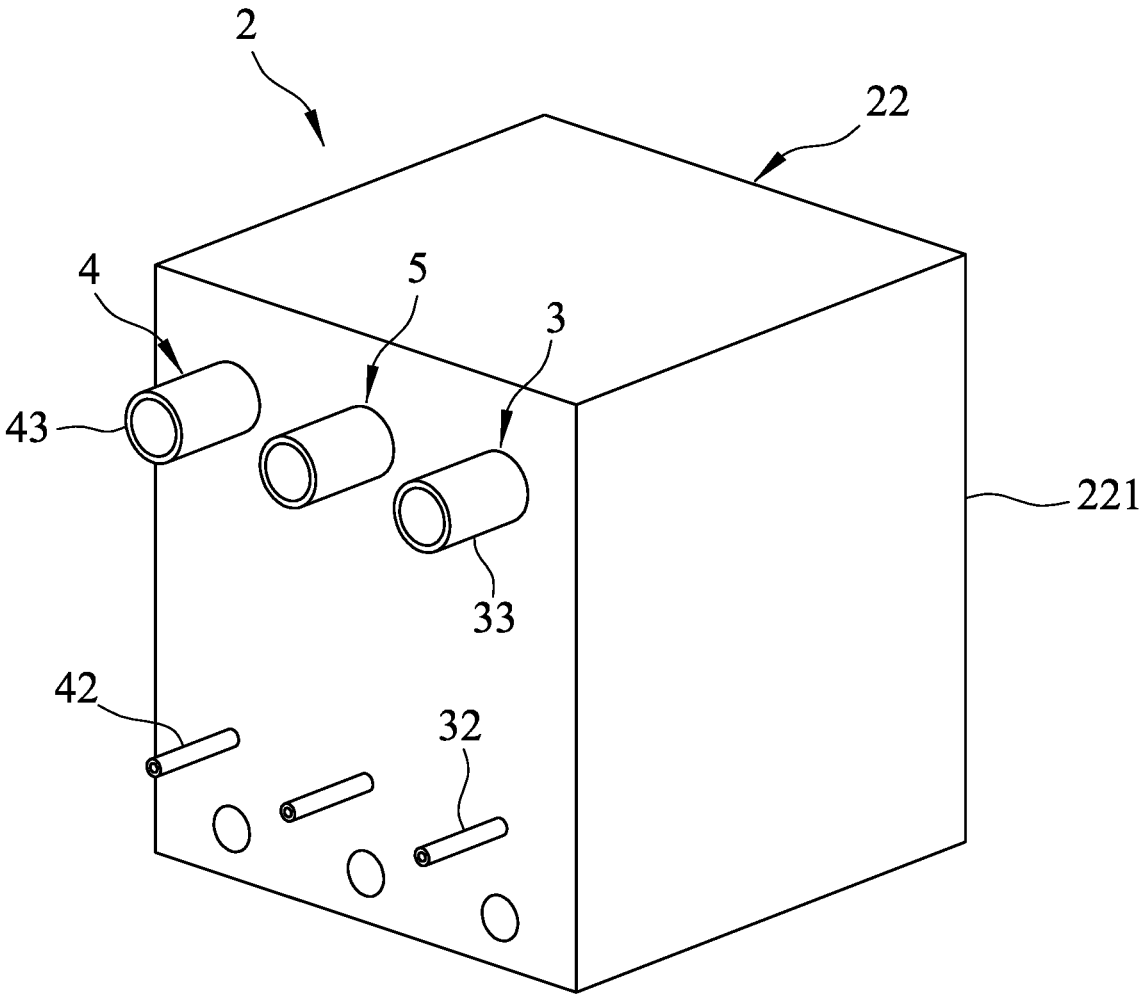
FIG. 9 is a perspective view of a third embodiment of an evaporator for a cascade refrigeration system according to the disclosure.
Figure 10:
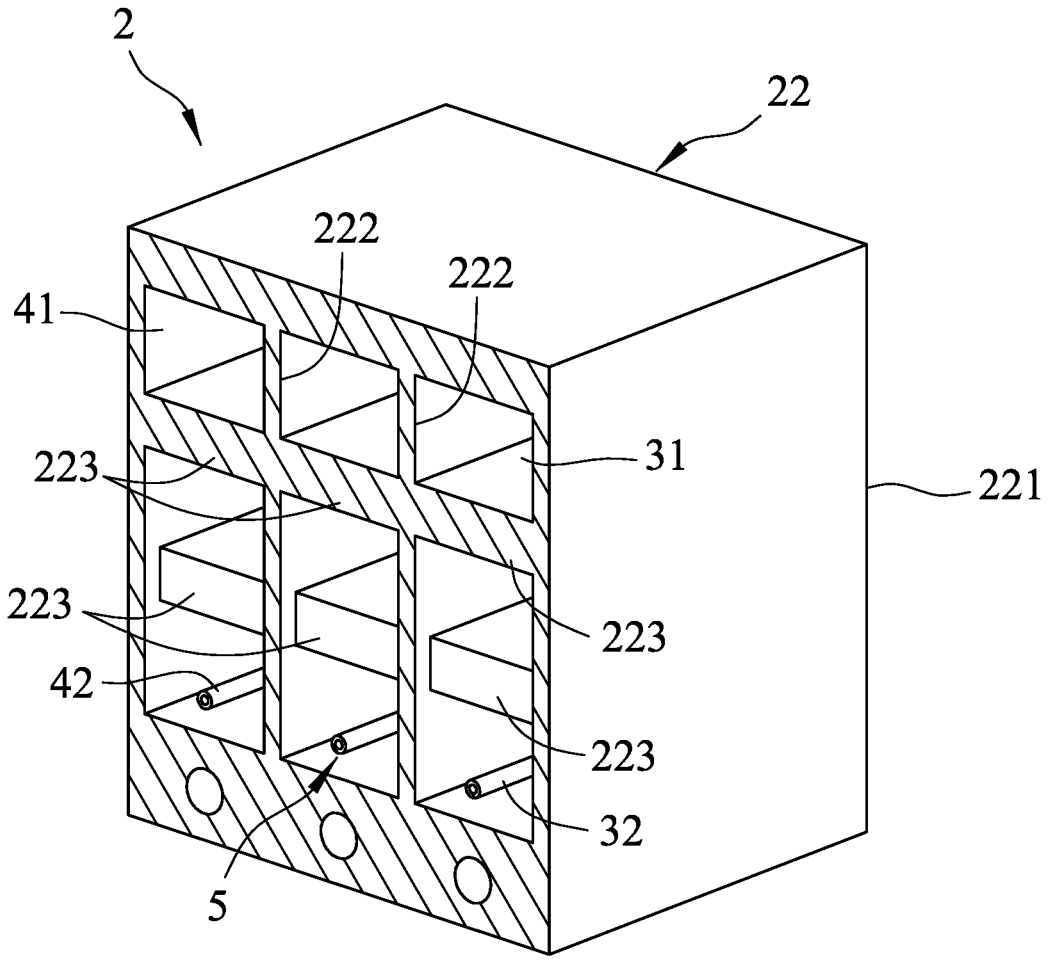
FIG. 10 is a view similar to FIG. 9, but with a portion thereof being removed to illustrate aspect of first to third circulation units thereof.

FIGS. 9 and 10 illustrate an evaporator 2 for a cascade refrigeration system according to the third embodiment of the disclosure which is generally similar to the second embodiment. However, in this embodiment, the casing 22 includes two spaced-apart partition plates 222 disposed in the casing body 221 and extending in a height direction of the casing body 221 to divide the casing body 221 into three parts, and the evaporator 2 further includes a third circulation unit 5 disposed on a middle one of the three parts of the casing body 221 and independent from the first and second circulation units 3, 4. Moreover, the first, second and third circulation units 3, 4, 5 do not fluidly communicate with each other. Since the third circulation 5 has a structure similar to those of the first and second circulation units 3, 4, details of the third circulation unit 5 are omitted herein.

In the third embodiment, aside from having the same advantages as those of the second embodiment, by virtue of the first, second and third circulation units 3, 4, 5 being independent from each other and not fluidly communicating with each other, the evaporator 2 of the disclosure can be applied to a triple refrigerant refrigeration system.

Figure 11:
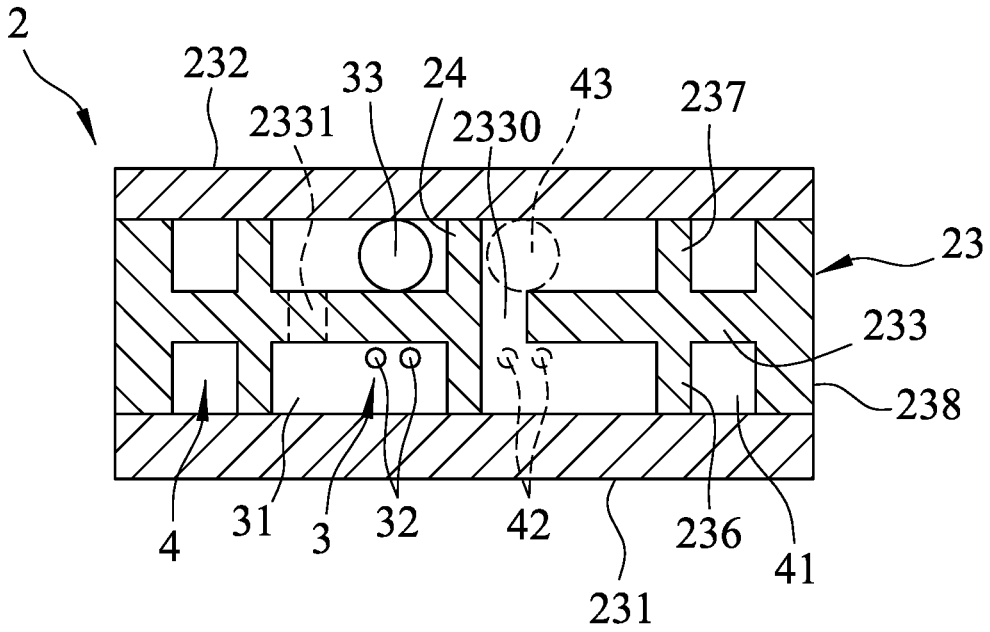
FIG. 11 is a sectional view of a fourth embodiment of an evaporator for a cascade refrigeration system according to the disclosure.
Figure 12:
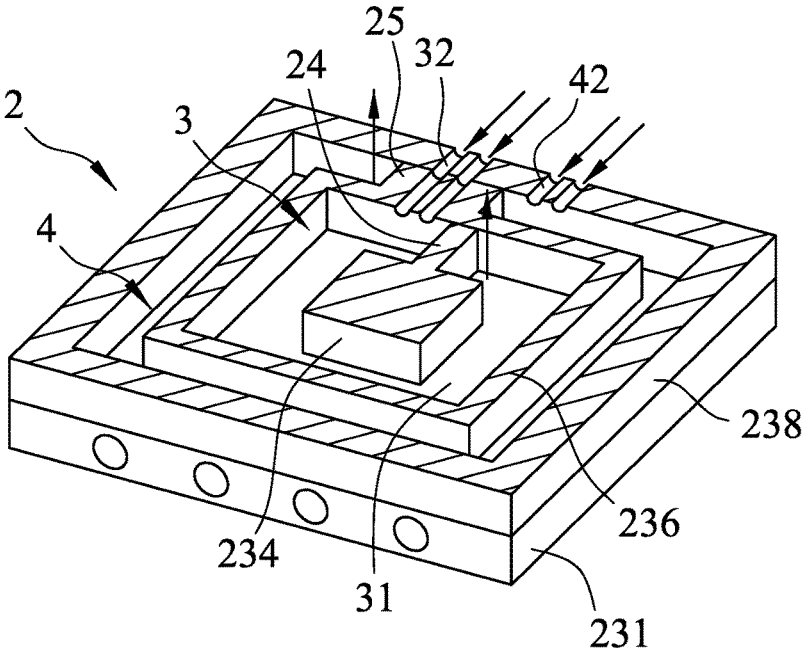
FIG. 12 is a partly sectional view of a lower part of a casing of the fourth embodiment.
Figure 13:
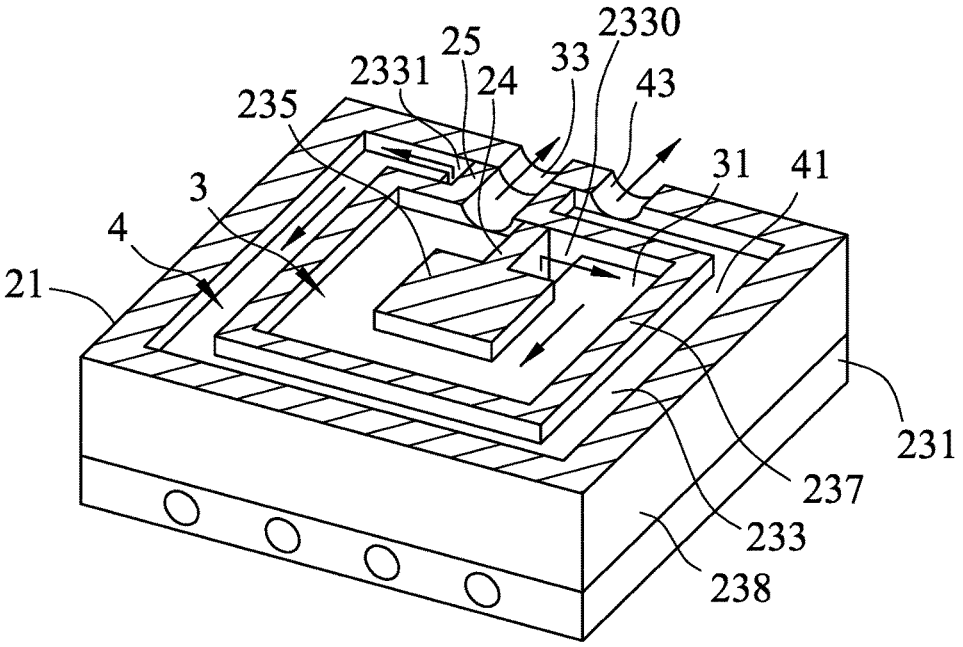
FIG. 13 is a partly sectional view of an upper part of the casing of the fourth embodiment with a top wall thereof being removed for the sake of clarity.

FIGS. 11 to 13 illustrate an evaporator 2 for a cascade refrigeration system according to the fourth embodiment of the disclosure which is generally similar to the second embodiment. The difference between the third and fourth embodiments resides in the structure of the casing 23. In the fourth embodiment, the casing 23 includes a base wall 231, atop wall 232 spaced apart from the base wall 231, a partition wall 233 disposed between the base and top walls 231, 232 and dividing the casing 23 into upper and lower parts, a first protruding post 234 interconnecting the base and partition walls 231, 233 and located in the lower part of the casing 23, a second protruding post 235 interconnecting the partition and top walls 233, 232 and located in the upper part of the casing 23, a first inner surrounding wall 236 interconnecting the base and partition walls 231,233 and spacedly surrounding the first protruding post 234, a second inner surrounding wall 237 interconnecting the partition and top walls 233,232 and spacedly surrounding the second protruding post 235, and an outer surrounding wall 238 connected to peripheries of the base, top and partition walls 231, 232, 233. Moreover, the casing 23 further includes a first cross wall 24 and a second cross wall 25. The first cross wall 24 extends from the base wall 231 to the top wall 232, interconnects the first protruding post 234 and the first inner surrounding wall 236, and interconnects the second protruding post 235 and the second inner surrounding wall 237. The second cross wall 25 extends from the base wall 231 to the top wall 232, interconnects the first inner surrounding wall 236 and the outer surrounding wall 238, and interconnects the second inner surrounding wall 237 and the outer surrounding wall 238.

In this embodiment, the partition wall 233 has a first through hole 2330 immediately adjacent the first cross wall 24, and a second through hole 2331 immediately adjacent the second cross wall 25. The first protruding post 234, the first inner surrounding wall 236, the second protruding post 235 and the second inner surrounding wall 237 cooperatively de fine the first flow path 31 of the first circulation unit 3 that extends from the lower part to the upper part of the casing 23 through the first through hole 2330. The first inner surrounding wall 236, the second inner surrounding wall 237 and the outer surrounding wall 238 cooperatively define the second flow path 41 of the second circulation unit 4 that extends from the lower part to the upper part of the casing 23 through the second through hole 2331. The second flow path 41 surrounds the first flow path 31.

The first inlet 32 of the first circulation unit 3 is located between the base wall 231 and the partition wall 233 and extends through the outer surrounding wall 228, the second cross wall 25 and the first inner surrounding wall 236 to fluidly communicate with the first flow path 31. The second inlet 42 of the second circulation unit 4 is located between the base wall 231 and the partition wall 233 and extends through the outer surrounding wall 238 to fluidly communicate with the second flow path 41. The second inlet 42 is proximate to the first inlet 32. The first outlet 33 of the first circulation unit 3 is located between the partition wall 233 and the top wall 232 and extends through the second inner surrounding wall 237, the second cross wall 25 and the outer surrounding wall 28 to fluidly communicate the first flow path 31 with an external environment. The second outlet 43 of the second circulation unit 4 is located between the partition wall 233 and the top wall 232 and extends through the outer surrounding wall 238 to fluidly communicate the second flow path 41 with the external environment. The second outlet 43 is proximate to the first outlet 33. The first inlet 32 and the first outlet 33 are spaced apart from and aligned with each other in a top-bottom direction relative to the casing 23. The second inlet 42 and the second outlet 43 are spaced apart from and aligned with each other in the top-bottom direction relative to the casing 23.

The first inlet 32 of the first circulation unit 3 permits entry of a first refrigerant into the casing 23. The first refrigerant enters the first inlet 32, flows from the lower part to the upper part of the casing 23 through the first through hole 2330 and along the first flow path 31, and exits out of the casing 23 through the first outlet 33, as shown by the arrows in FIGS. 12 and 13. The second inlet 42 of the second circulation unit 4 permits entry of a second refrigerant into the casing 23. The second refrigerant enters the second inlet 42, flows from the lower part to the upper part of the casing 23 through the second through hole 2331 and along the second flow path 41, and exits out of the casing 23 through the second outlet 43, as shown by the arrows in FIGS. 12 and 13.

The fourth embodiment has the same advantages as those of the second embodiment.

Reference in the specification to "one embodiment" or "an embodiment" means that a particular feature, structure, or characteristic described in connection with the embodiment may be included in at least an implementation. The appearances of the phrase "in one embodiment" in various places in the specification may or may not be all referring to the same embodiment. Various features, aspects, and exemplary embodiments have been described herein. The features, aspects, and exemplary embodiments are susceptible to combination with one another as well as to variation and modification, as will be understood by those having skill in the art.

This disclosure is not limited to the disclosed exemplary embodiments but is intended to cover various arrangements included within the spirit and scope of the broadest interpretation so as to encompass all such modifications and equivalent arrangements.

What is claimed is:

1. An evaporator for a cascade refrigeration system comprising:

a casing including a base seat and a connection seat stacked on said base seat; and two of circulation units respectively disposed on said base seat and said connection seat, each of said circulation units including a flow path formed in a respective one of said base seat and said connection seat, an inlet formed in the respective one of said base seat and said connection seat for entry of one of refrigerants into said casing and fluidly communicating with said flow path, and an outlet formed in the respective one of said base seat and said connection seat and spaced apart from said inlet for exit of the one of the refrigerants out of said casing and fluidly communicating with said flow path;

wherein said circulation units are independent from each other and do not fluidly communicate with each other;

wherein said base seat includes a base wall, a first surrounding wall surrounding said base wall, and a first partition plate protruding inwardly from said first surrounding wall;

wherein said connection seat includes a connecting wall connected to said first surrounding wall opposite to said base wall, a second surrounding wall surrounding said connecting wall, a second partition plate protruding inwardly from said second surrounding wall, and a top wall connected to said second surrounding wall opposite to said connecting wall;

wherein said base wall, said first surrounding wall, said first partition plate and said connecting wall cooperatively define said flow path of said circulation unit formed in said base seat, said flow path in said base seat having a substantially C-shape; and wherein said connecting wall, said second surrounding wall, said second partition plate and said top wall cooperatively define said flow path of said circulation unit formed in said connection seat, said flow path formed in said connection seat having a substantially C-shape.

2. An evaporator for a cascade refrigeration system comprising:

a casing; and a plurality of circulation units disposed on said casing, each of said circulation units including a flow path formed in said casing, an inlet formed in said casing for entry of one of refrigerants into said casing and fluidly communicating with said flow path, and an outlet formed in said casing spaced apart from said inlet for exit of the one of the refrigerants out said casing and fluidly communicating with said flow path;

wherein said circulation units are independent from each other and do not fluidly communicate with each other;

wherein said casing includes a base wall, a top wall spaced apart from said base wall, a partition wall disposed between said base and top walls and dividing said casing into upper and lower parts, a first protruding post interconnecting said base and partition walls and located in said lower part of said casing, a second protruding post interconnecting said partition and top walls and located in said upper part of said casing, a first inner surrounding wall interconnecting said base and partition walls and spacedly surrounding said first protruding post, a second inner surrounding wall interconnecting said partition and top walls and spacedly surrounding said second protruding post, and an outer surrounding wall connected to peripheries of said base, top and partition walls;

wherein said casing further includes a first cross wall interconnecting said first protruding post and said first inner surrounding wall and interconnecting said second protruding post and said second inner surrounding wall, and a second cross wall interconnecting said first inner surrounding wall and said outer surrounding wall and interconnecting said second inner surrounding wall and said outer surrounding wall;

wherein said evaporator comprises two said circulation units;

wherein said partition wall has a first through hole immediately adjacent said first cross wall, and a second through hole immediately adjacent said second cross wall;

wherein said first protruding post, said first inner surrounding wall, said second protruding post and said second inner surrounding wall cooperatively define said flow path of one of said circulation units that extends from said lower part to said upper part of said casing through said first through hole;

wherein said first inner surrounding wall, said second inner surrounding wall and said outer surrounding wall cooperatively define said flow path of the other one of said circulation units that extends from said lower part to said upper part of said casing through said second through hole; and wherein said inlet of said one of said circulation units is located between said base wall and said partition wall and extends through said outer surrounding wall, said second cross wall and said first inner surrounding wall for entry of the one of the refrigerants into said lower part of said casing, said inlet of the other one of said circulation units is located between said base wall and said partition wall and extends through said outer surrounding wall for entry of the other one of the refrigerants into said lower part of said casing, said outlet of said one of said circulation units is located between said partition wall and said top wall and extends through said second inner surrounding wall, said second cross wall and said outer surrounding wall for exit of the one of the refrigerants out of said casing, and said outlet of the other one of said circulation units is located between said partition wall and said top wall and extends through said outer surrounding wall for exit of the other one of the refrigerants out of said casing, said inlet and said outlet of each of said circulation units being spaced apart from each other in a top-bottom direction.

* * * * *